US007098782B1

(12) United States Patent
Peckham et al.

(10) Patent No.: US 7,098,782 B1
(45) Date of Patent: Aug. 29, 2006

(54) METHOD AND APPARATUS FOR TEMPORARY MUTING OF SMOKE ALARMS

(76) Inventors: David P. Peckham, 280 Ingham Hill Rd., Old Saybrook, CT (US) 06475; John O. Della Morte, Jr., 221 Old Main St., Sandwich, MA (US) 02563

( * ) Notice: Subject to any disclaimer, the term of this patent is extended or adjusted under 35 U.S.C. 154(b) by 0 days.

(21) Appl. No.: 10/631,153

(22) Filed: Jul. 31, 2003

(51) Int. Cl.
*G08B 23/00* (2006.01)

(52) U.S. Cl. ..... 340/500; 340/517; 340/287

(58) Field of Classification Search ..... 340/527, 340/529, 530, 309.3, 309.4, 309.8, 309.16, 340/628, 550, 517, 519, 500, 287
See application file for complete search history.

(56) References Cited

U.S. PATENT DOCUMENTS 4,064,508 A * 12/1977 Simon ..... 340/519
4,141,007 A * 2/1979 Kavasilios et al. ..... 340/500
4,313,110 A 1/1982 Subulak et al.
4,477,798 A 10/1984 Saul et al.
4,600,314 A 7/1986 Theriault
4,788,530 A 11/1988 Bernier
4,814,748 A * 3/1989 Todd ..... 340/527
5,093,651 A 3/1992 Thomas
5,432,500 A * 7/1995 Scripps ..... 340/628
5,442,336 A 8/1995 Murphy et al.
5,815,066 A 9/1998 Pumilia
6,144,289 A 11/2000 LeBel

OTHER PUBLICATIONS

"Remote-Controlled Smoke & Fire Alarm," http://www.smarthome.com/7981.html, downloaded Sep. 3, 2003 (2 pp.).
"First Alert SA302 Smoke Alarm," http://www.firstalert.com/sa302/, downloaded Sep. 3, 2003 (3 pp.).

* cited by examiner

*Primary Examiner*—Van T. Trieu
(74) *Attorney, Agent, or Firm*—Hamilton, Brook, Smith & Reynolds, P.C.

(57) ABSTRACT

A switch temporarily disconnects an alarm system from an external power source when a person activates an actuator in a false alarm situation. After a predetermined length of time, the switch is automatically changed to a position that allows power to resume flowing to the alarm system. The alarm system is formed of an alarm unit or a series of two or more alarm units electrically connected together.

15 Claims, 5 Drawing Sheets

METHOD AND APPARATUS FOR TEMPORARY MUTING OF SMOKE ALARMS

BACKGROUND OF THE INVENTION

Smoke alarms are desirable and even necessary to ensure the safety of every person in a household. At times, however, smoke alarms can be a nuisance. Often, cooking smoke or cigarette smoke will set off a smoke alarm. Also, water vapor from a shower can set off a smoke alarm.

To address such problems, smoke alarms have been retrofitted with a switch to temporarily deactivate the smoke alarms. These retrofitted smoke alarms require the use of a remote control, a switch, or a pull cord to turn off the smoke alarms. Examples include U.S. Pat. No. 4,313,110, U.S. Pat. No. 5,093,651, U.S. Pat. No. 5,442,336, and U.S. Pat. No. 5,815,066.

SUMMARY OF THE INVENTION

The problem with retrofitting a smoke alarm with the switches of the prior art is that a person has to either buy a new smoke alarm or go into an existing smoke alarm and add new components. Thus, a household having several smoke alarms would require either replacing each existing smoke alarm with the new retrofitted smoke alarms or retrofitting the new components into each of the existing smoke alarms in the household. Such an endeavor can prove to be expensive.

The present invention, however, requires a single switch. The switch is placed between an external power source and a series of alarms connected to that power source. Indeed, recent homes are constructed with smoke alarms wired in parallel and connected to an external Alternating Current (AC) power source. In these homes the invention switch can be placed between the alarms and the external power source. Likewise, in homes that are now under construction or about to be, the switch may be wired between the external power source and the series of alarms.

In summary, the present invention is a switch device that is placed between an external AC power source and a series of smoke alarms wired in parallel. The switch device receives AC power from the external AC power source and opens or closes the electrical connection between the external power source and the series of alarms. When it is desired to temporarily disable the series of alarms, an actuator in the form of a button on a wall or on a remote control is activated, causing a capacitor to charge. The capacitor bleeds across a series of resistors and provides current to cause a transistor to conduct. The flow of current across the transistor activates a relay which opens the connection between the external power source and the series of alarms. Once the capacitor is bled (no longer holds a threshold amount of charge), the transistor discontinues conducting and the relay returns to its normally closed position allowing AC current to flow between the external power source and the series of alarms.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
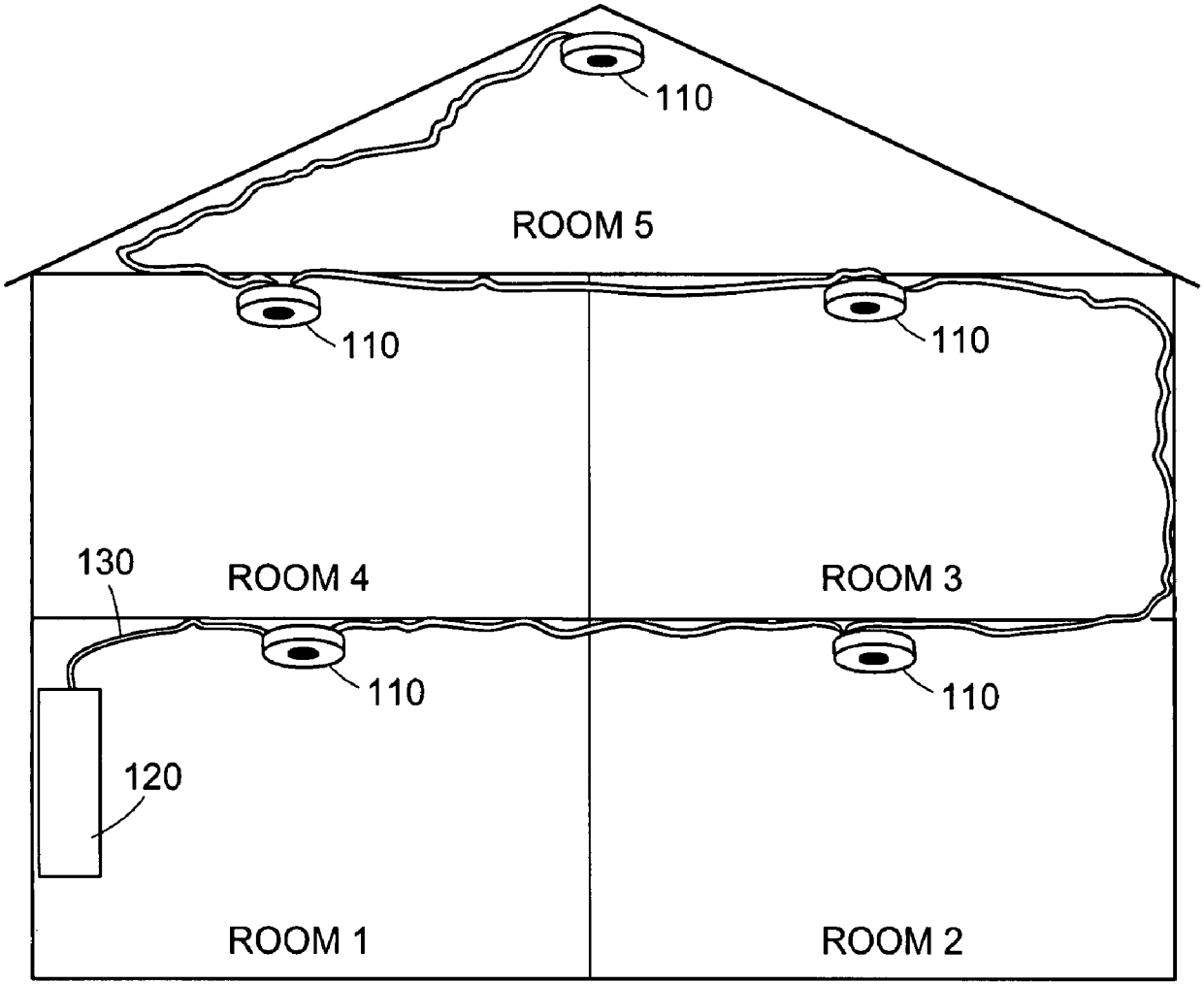
FIG. 1 is a schematic view illustrating the typical wiring of a smoke alarm system in a home.

Homes are now constructed with multiple alarm units 110 connected in parallel to a breaker box 120 via a main power line 130 supplying AC power, as shown in FIG. 1. As a result, homeowners no longer have to be bothered by low battery alarms or by having to replace the smoke alarm battery in each individual alarm unit. Nevertheless, the smoke alarm units 110 can still be set off by cooking smoke, cigarette smoke, and water vapor from the shower. Such produces a false-positive alarm situation where no threat exists.

Figure 2:
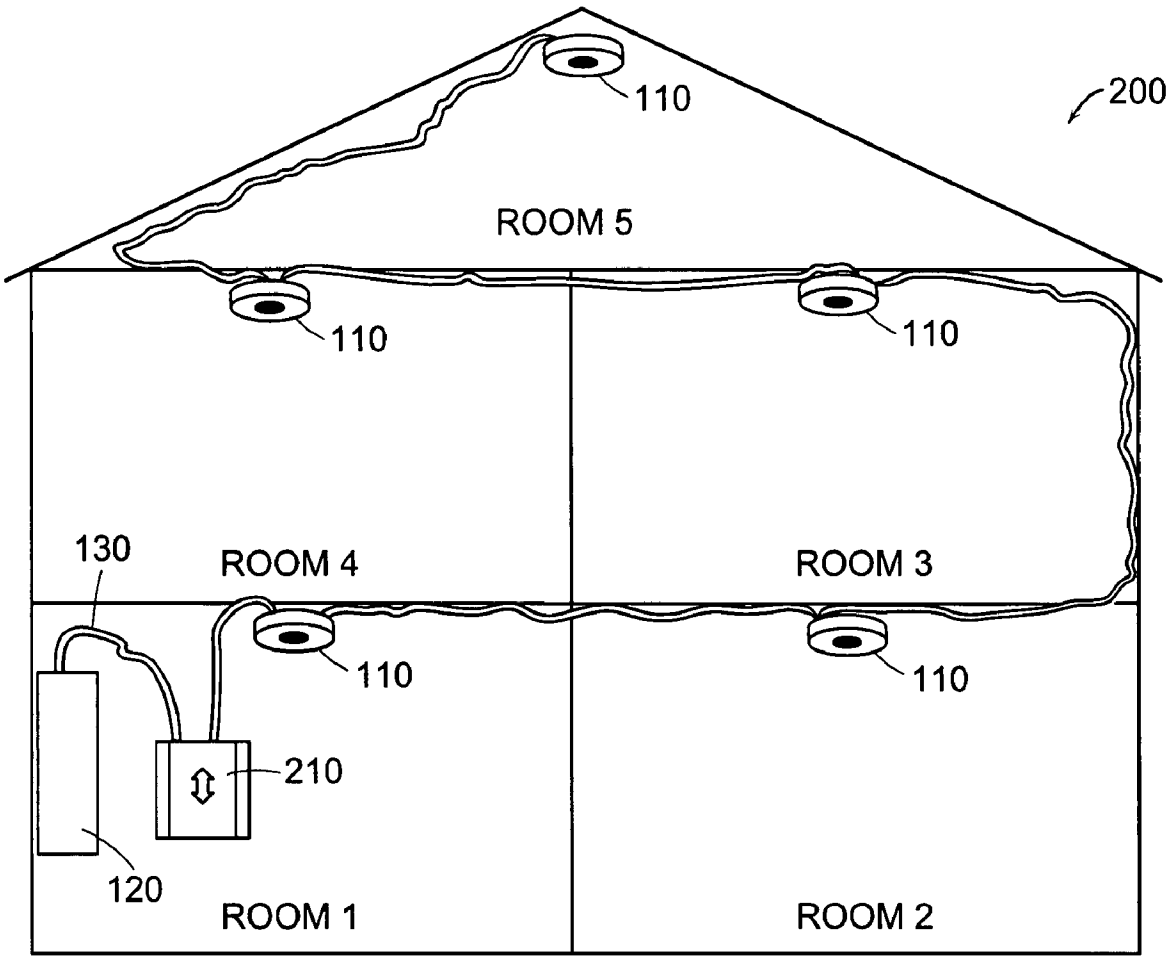
FIG. 2 is a schematic view of one embodiment of the present invention placed in the typical home wiring of FIG. 1.

In the present invention, as shown in FIG. 2, a switch device 210 may be activated to disable the smoke alarm units 110 set off by any non-threatening condition. The switch device 210 receives the main power line 130 coming from the breaker box 120 and provides power to the series of alarm units 110 wired in parallel. Such a configuration represents a typical smoke alarm system wiring using the invention switch device 200.

Figure 3:
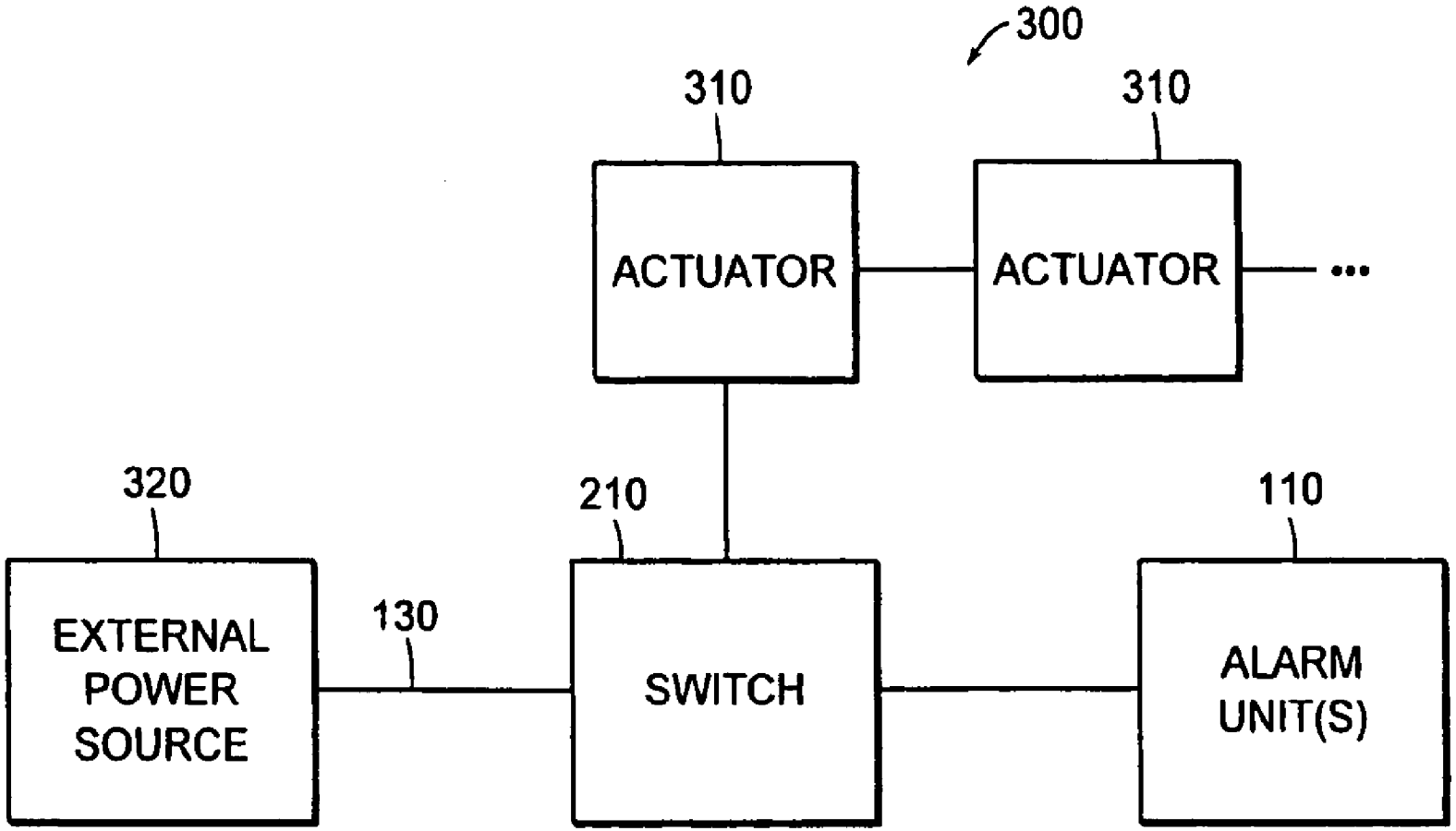
FIG. 3 is a block diagram of a smoke alarm system with a switch embodying the present invention.

A block diagram for an alarm system 300 of the present invention is shown in FIG. 3. FIG. 3 more particularly illustrates the switch device 210 (or generally switch 210) connecting to an external power source 320 through the main power line 130. The switch 210 also connects to (or is responsive to) an actuator 310 and connects to the series of alarm units 110. When a person activates the actuator 310, the switch 210 is changed from a normally closed position to an open position, thus disallowing power to flow between the external power source 320 and the alarm units 110. After a predetermined length of time, the switch 210 changes from the open position to the closed position, thus allowing power to resume flowing between the external power source 320 and the alarm units 110. Multiple actuators 310 may be placed throughout a home so that whether a person is in the shower or in the kitchen cooking the person can easily access the actuator 310 and in turn operate the switch 210.

Figure 4:
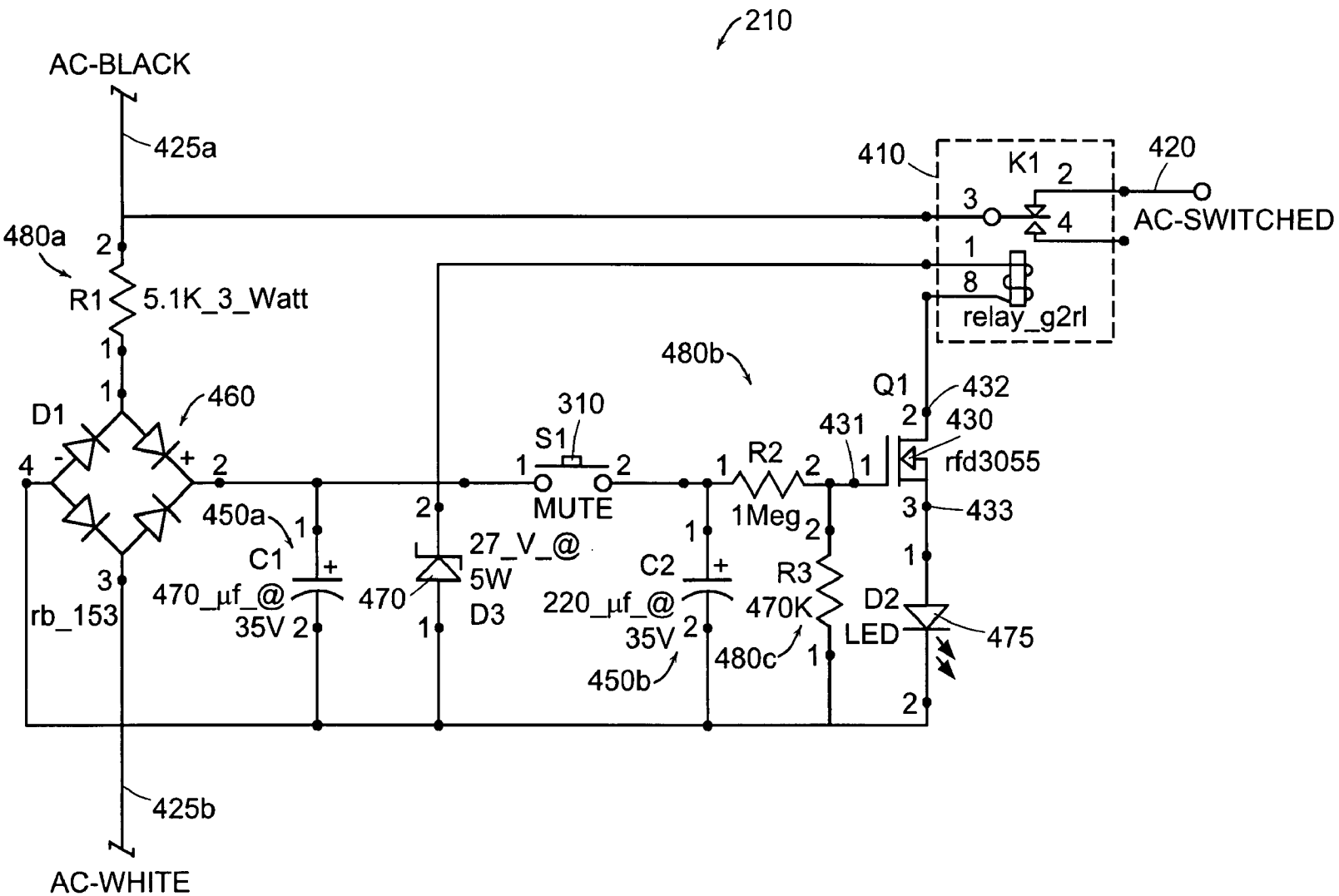
FIG. 4 is a circuit diagram of the switch of FIG. 3.

Unlike battery operated smoke alarms, the smoke alarm systems in newly constructed homes receive power from an external AC power source. FIG. 4 shows an electrical circuit for the switch device 210 designed to connect an external AC power source to the alarm units 110. The electrical circuit for the switch device 210 receives AC power from an AC black wire (hot) 425*a* and an AC white wire (common) 425*b*. The AC black wire 425*a* connects to one node of four diodes in a bridge configuration 460 through a first resistor 480*a*. The AC white wire 425*b* connects to another node of the four diodes in the bridge configuration 460. The four diodes in the bridge configuration 460 form a rectifier which converts the Alternating Current (AC) received through the AC black wire 425*a* and the AC white wire 425*b* to Direct Current (DC) to power the switch device 210 circuitry. The positive and negative terminals (the remaining two nodes) of the rectifier 460 connect to a first capacitor 450*a* which is charged when AC power is applied to the AC black wire 425*a* and the AC white wire 425*b*. A second capacitor 450*b* connects in parallel to the first capacitor 450*a* through the actuator 310. Thus, when a person activates the actuator 310, the second capacitor 450*b* receives charge from the first capacitor 450*a*.

The second capacitor 450*b* connects to a base 431 of a MOSFET 430 through a second resistor 480*b*. When the second capacitor 450*b* has sufficient charge, the voltage drop across the second resistor 480*b* provides current to the MOSFET 430 such that the MOSFET 430 conducts between its drain 432 and source 433. The source 433 of the MOSFET 430 is connected to the negative terminal of the rectifier 460 through an LED 475. Thus, when the MOSFET 430 conducts, the LED 475 illuminates.

The drain 432 of the MOSFET 430 connects to the positive terminal of the rectifier 460 through a relay 410. When the MOSFET 430 conducts, the relay 410 is activated. The relay 410 disconnects the AC black wire 425*a* from an output terminal 420 which connects to the alarm units 110 (FIG. 3). When the relay 410 deactivates, the output terminal 420 is reconnected to the AC black wire 425*a*. The relay 410 remains activated so long as sufficient charge remains in the second capacitor 450*b* to cause the MOSFET 430 to conduct. A third resistor 480*c* is placed in parallel with the second capacitor 450*b* to bleed the second capacitor 450*b*. After a predetermined length of time, as determined by the values of the second capacitor 450*b* and the third resistor 480*c*, the second capacitor 450*b* will have insufficient charge to cause the MOSFET 430 to conduct. When the MOSFET 430 stops conducting, the relay 410 is deactivated and a connection between the output terminal 420 and the AC black wire 425*a* resumes. A diode 470 is also placed in parallel with the rectifier 460 to protect the relay 410.

The predetermined length of time is consistent with safety standards so that alarm units 110 are properly powered to detect any threatening conditions. Thus the present invention provides a temporary muting (or disabling) of alarm units 110 upon user command and automatically resumes 'normal' operation of alarm units 110 after being muted for a safe amount of time. There is minimal to no loss of safety measures (smoke detection) with the present invention.

Further it is noted that switch device 210 and its circuit effects temporary muting of all alarm units 110 at the same time (simultaneously). Thus the user does not have to tend to attempt to mute each alarm unit 110 individually as in the prior art. This is due to (i) the invention switch device 210 acting on the main power supply (main power line 130) which is external to (and not an integral or internal part of) the series of alarm units 110, and (ii) the series of alarm units 110 together being wired to main power line 130.

Figure 5:
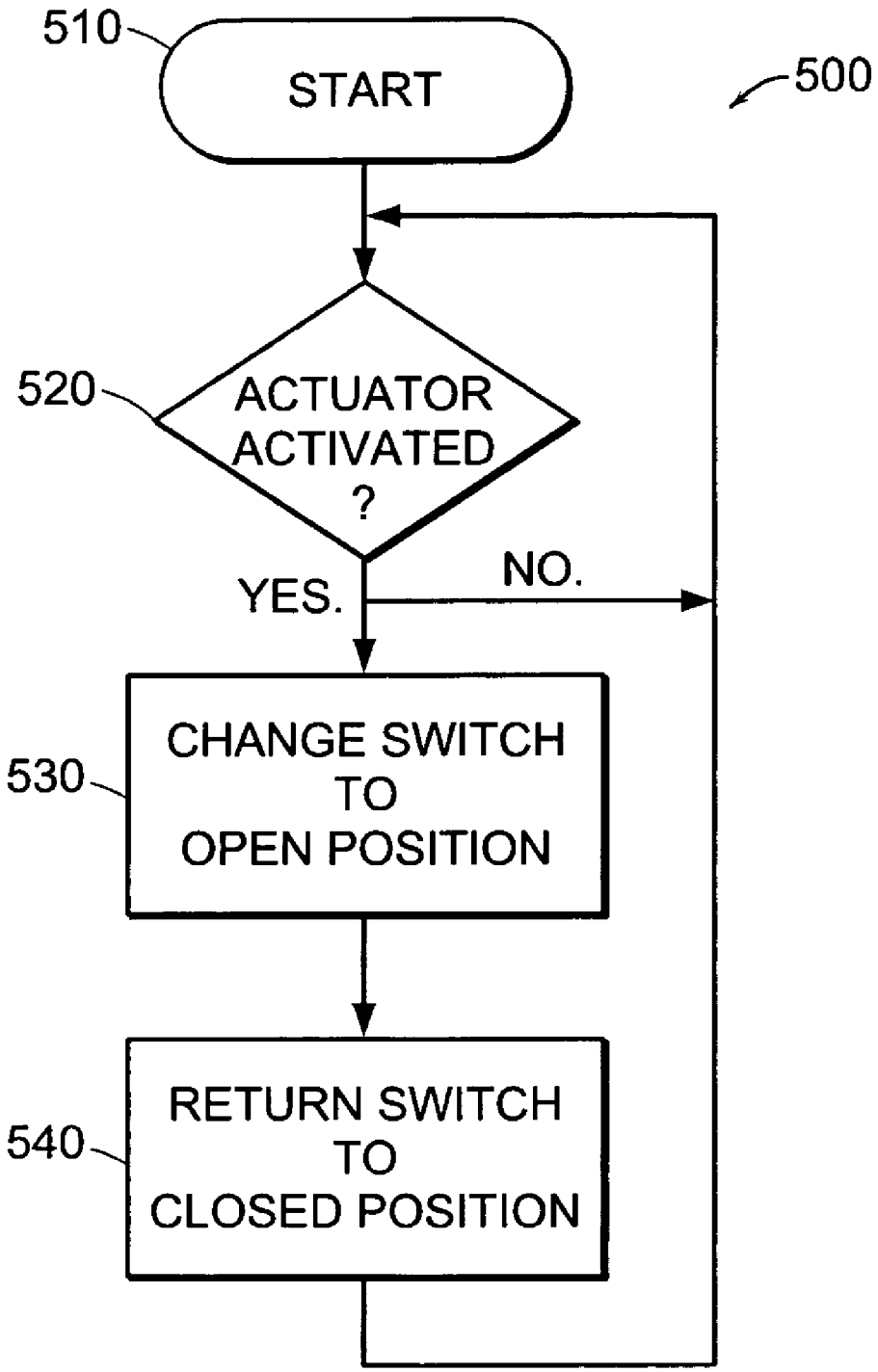
FIG. 5 is a flow chart of the switching process of the embodiment of FIG. 3.

FIG. 5 illustrates a flow chart for a switching process 500 employed by the switch device 210 of FIGS. 3 and 4. The switch device 210 begins with step 510 in which the process starts. In step 520, the process determines whether the actuator 310 has been activated. If the actuator 310 has not been activated, the process continues to monitor whether the actuator 310 has been activated. If in step 520 the actuator 310 is detected to be activated, the process in step 530 changes the switch 210 from its normally closed position to the open position. In the embodiment shown in FIG. 4, this is accomplished by charging capacitor 450*b*, which causes a voltage drop across resistor 480*b*, which provides current to MOSFET 430, which in turn conducts to illuminate LED 475 and to activate relay 410 disconnecting the series of alarm units 110 from external power source 320. After a predetermined length of time (the capacitor 450*b* has bled its charge to a level insufficient to cause the MOSFET 430 to conduct), the process 500 returns the switch 210 to the normally closed position in step 540. After step 540, the process 500 repeats step 520 and determines whether the actuator has been activated.

While this invention has been particularly shown and described with references to preferred embodiments thereof, it will be understood by those skilled in the art that various changes in form and details may be made therein without departing from the scope of the invention encompassed by the appended claims.

For example, the foregoing illustrates use of a switch 210 with a normally closed position which upon user activation becomes temporarily changed to an open position. It is understood that a variety of switch devices 210 may be employed so that in one (a first) position the switch 210 allows power to flow from the power source 320 to the series of alarm units 110, and in another (a second) position, the switch 210 temporarily disconnects power from the series of alarm units 110. After the predetermined length of time the switch 210 returns or changes to a position (e.g., its first or normal position) that allows power to flow to the series of alarm units 110.

One or more switches may form switch device 210. Type, number, and design of switches forming switch device 210 is in the purview of one skilled in the art given the above description of the present invention. Similarly, one or more actuators may form the actuator 310 connecting to the switch 210. Thus, a person can activate the switch using any number of actuators located throughout a home. This spares a person the inconvenience of having to operate a single actuator located in a room other than the room in which the person is present and in which a non-threatening condition occurs. For example, the water vapor caused by a person showering in an upstairs bedroom can set off the alarm units 110. In such a situation, the person can operate an actuator located in the upstairs bedroom rather than travel to another room, such as a downstairs kitchen, to temporarily deactivate the alarm units 110.

Also, the switch device 210 circuit of FIG. 4 illustrates use of a MOSFET 430. Other transistors or similar components are suitable. The above described circuit and circuit elements are for purposes of illustration and not limitation of the present invention switch device 210.

What is claimed is:

1. An alarm system comprising:

at least two alarm units coupled to each other to form the alarm system; and a switch remote from and coupled to each alarm unit, the switch for providing power to each alarm unit, the switch including a first actuator for temporarily interrupting the power supplied to each alarm unit and for automatically restoring power to each alarm unit after temporarily interrupting the power supplied to each alarm unit.

2. The alarm system as claimed in claim 1 further comprising at least a second actuator remote from and coupled to the first actuator for providing an alternate location for temporarily interrupting the power supplied to each alarm unit.

3. The alarm system as claimed in claim 1 wherein the the switch includes:

first position for providing power to each alarm unit; and a second position for temporarily interrupting the power supplied to each alarm unit.

4. The alarm system as claimed in claim 3 wherein the switch is normally in the first position to provide power to each alarm unit.

5. The alarm system as claimed in claim 1 wherein the switch is coupled in parallel to each alarm unit.

6. The alarm system as claimed in claim 1 wherein the power supplied to each alarm unit is temporarily interrupted for a predetermined length of time.

7. The alarm system as claimed in claim 6 wherein a capacitor value determines the predetermined length of time.

8. A method for temporarily disabling an alarm system comprising the steps of:

coupling a power source to at least two alarm units of the alarm system;

signaling an alarm condition throughout the alarm system;

temporarily interrupting the power source supplying power to the alarm system from a remote location; and automatically restoring power to the alarm system thereby temporarily disabling the alarm condition.

9. The method as claimed in claim 8 wherein the step of temporarily interrupting a power source supplying the alarm system includes activating an actuator that switches a relay from a first position to a second position.

10. The method as claimed in claim 9 wherein the first position provides power to the alarm system.

11. The method as claimed in claim 9 wherein the second position temporarily interrupts power to the alarm system.

12. The method as claimed in claim 11 wherein the power is interrupted for a predetermined length of time.

13. The method as claimed in claim 12 wherein a capacitor value determines the predetermined length of time.

14. The method as claimed in claim 9 wherein the step of restoring the power to the alarm system includes switching the relay from the second position to the first position.

15. The method as claimed in claim 8 wherein the power is coupled in parallel to the alarm units.

* * * * *